30
62
61
54
52
82
88
40
34
32
36
66
54
88
12
18
52
50
60
72
74
76
69
70
22
14
16

United States Patent [19]

Landowski

[11] 4,159,100

[45] Jun. 26, 1979

[54] FORMS FOR PRE-CAST CONCRETE PANELS

[76] Inventor: Edmund A. Landowski, P.O. Box 66, Schofield, Wis. 54476

[21] Appl. No.: 849,056

[22] Filed: Nov. 7, 1977

[51] Int. Cl.[2] ..... B28B 7/02

[52] U.S. Cl. ..... 249/99; 249/158; 249/165; 249/219 R

[58] Field of Search ..... 249/13, 158, 163, 165, 249/192, 195, 196, 99, 219 R

[56] References Cited

U.S. PATENT DOCUMENTS

| | | | |
|---|---|---|---|
| 896,330 | 8/1908 | Scheelky | 249/158 |
| 2,046,123 | 6/1936 | Jennings | 249/191 |
| 2,721,368 | 10/1955 | Landrum | 249/158 |
| 2,870,516 | 1/1959 | Jennings | 249/195 |
| 2,924,962 | 2/1960 | Nettle | 249/13 |

*Primary Examiner*—Roy Lake
*Assistant Examiner*—John McQuade
*Attorney, Agent, or Firm*—Wheeler, Morsell, House & Fuller

[57] ABSTRACT

Disclosed herein is a concrete form assembly for pre-casting concrete walls which includes a three-piece base plate, side rails and headers which interfit between the side rails and can be adjusted to any spacing for different length and width concrete wall panels. A quick release clamp has a pin which interfits with registrable apertures in the form parts for fastening the base plate, side rails and headers in unitary assembly during the pouring process. A cam surface on one of the clamp jaws urges the form parts together when the clamp is swung into clamping position. Out-turned flanges on the side rails and projecting portions on the headers provide clamping surfaces.

3 Claims, 12 Drawing Figures

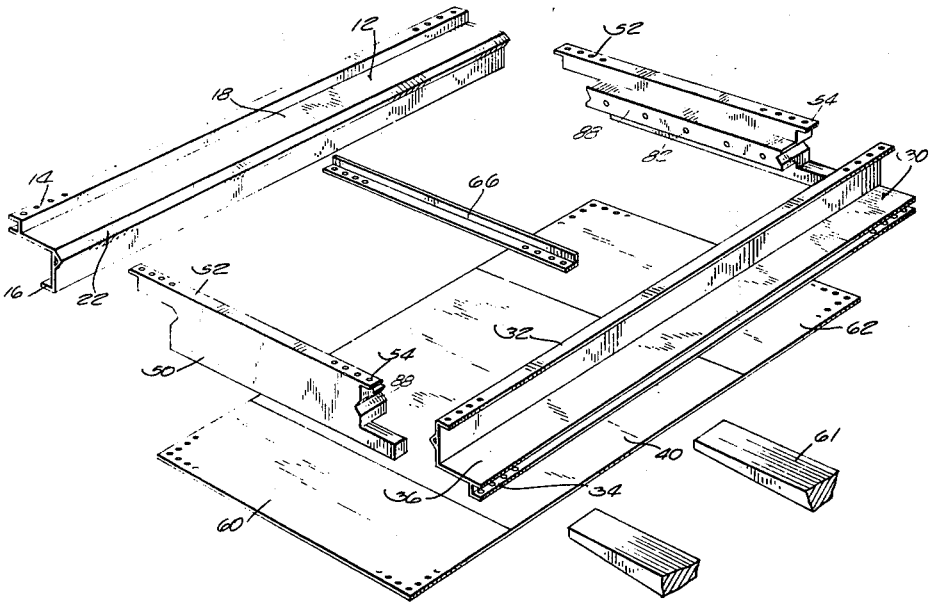

FORMS FOR PRE-CAST CONCRETE PANELS

BACKGROUND OF INVENTION

Pre-casting of concrete wall panels for buildings and other structures requires the casting of a large quantity of wall panels for each particular building. My prior U.S. Pat. No. 3,874,139 discloses pre-cast concrete wall panels suitable for a wide range of building projects. Typically, concrete forms are bolted together to provide a unitary assembly of the forms during the pouring process. The connection of form parts with bolts takes a good deal of time in assembly and disassembly and is not convenient for mass producing large quantities of panels.

SUMMARY OF INVENTION

The invention provides a concrete form assembly in which the base plate, side rails and headers have clampable surfaces resulting from integral flanges and protecting portions so that quick release clamps can be employed to assemble and disassemble the forms. The clamps have projecting pins which interfit with registrable apertures on the side rails, headers and base plate. A ramp or cam surface on one jaw of each of the clamps provides camming pressure when the clamp is swung to clamp the jaws against the form parts.

A three-piece base assembly is provided, with the central piece wide enough to support the entire molded concrete panel and enable the central piece and cast panel to be manipulated by a forklift truck after the concrete is poured and has set to take the panel to a curing site. After the concrete has set, side rails and headers can be removed and used with other base plates to minimize the number of mold parts required for mass producing large quentities of panels.

A divider is adjustable longitudinally of the side rails for different length panels, and a side rail is provided which interfits within the headers for varying the width of the panels.

Further objects, advantages and features of the invention will become apparent from the disclosure.

DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
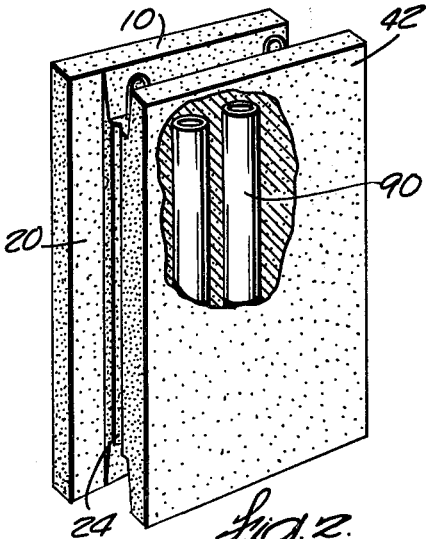
FIG. 2 is a concrete wall panel molded in the form.

The concrete wall panel 10 illustrated in FIG. 2 has a shape in accordance with the panels disclosed in my U.S. Pat. No. 3,874,139. The illustrated embodiment of the concrete form assembly of the invention is constructed to make panels as shown in FIG. 2.

Figures 1, 12:
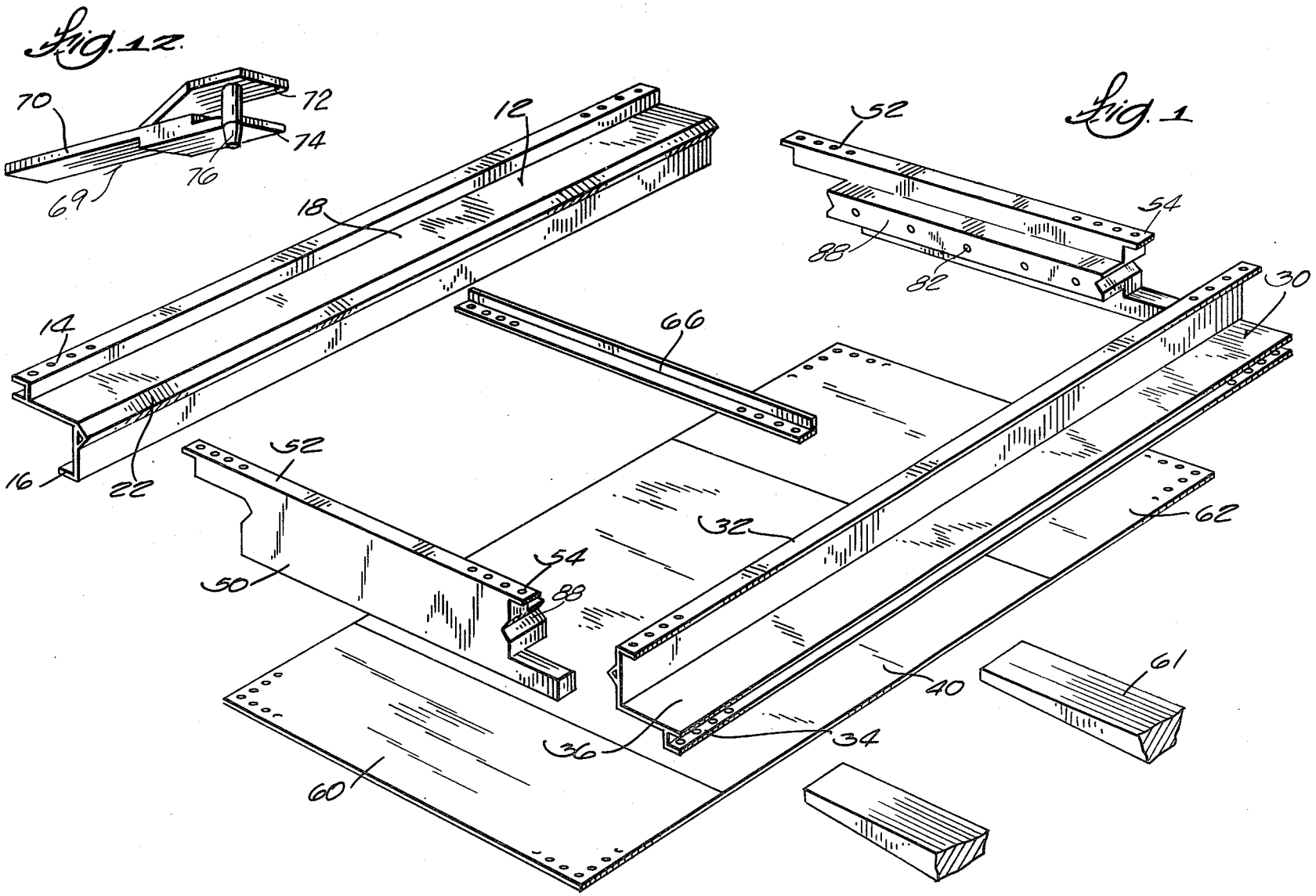
FIG. 1 is an exploded perspective view of the mold parts of the invention.
FIG. 12 is a perspective view of the clamp shown in FIG. 7.
Figure 3:
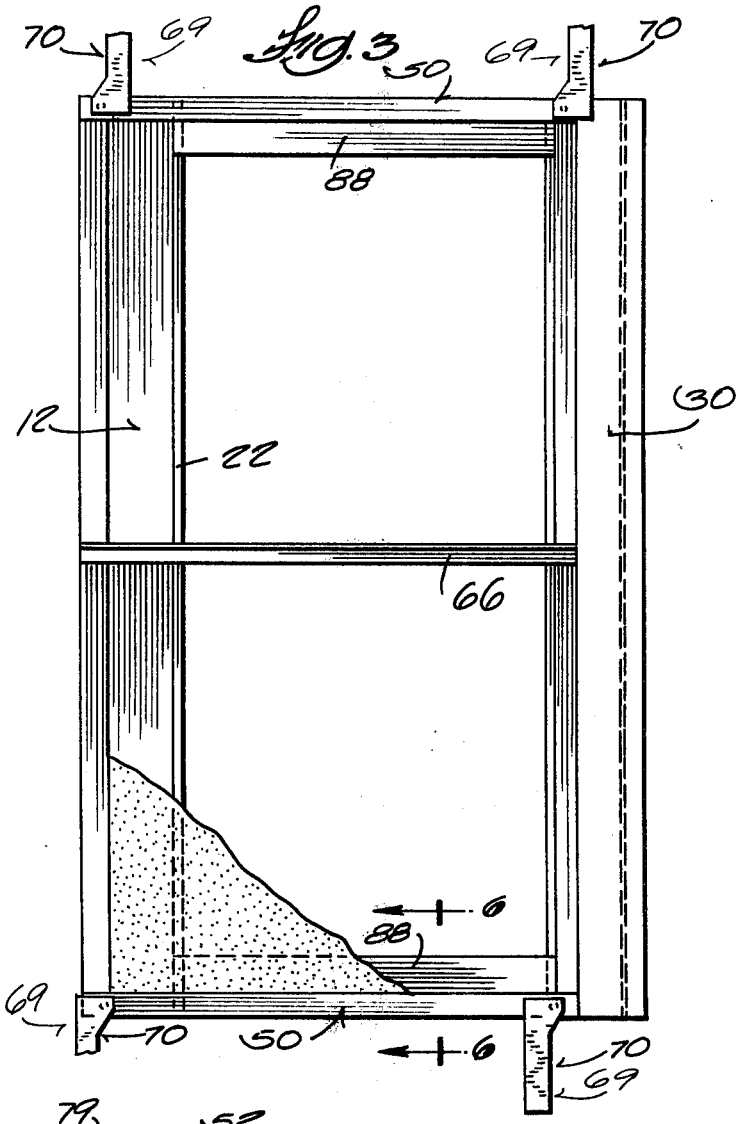
FIG. 3 is a plan view of the assembled mold parts.
Figure 4:
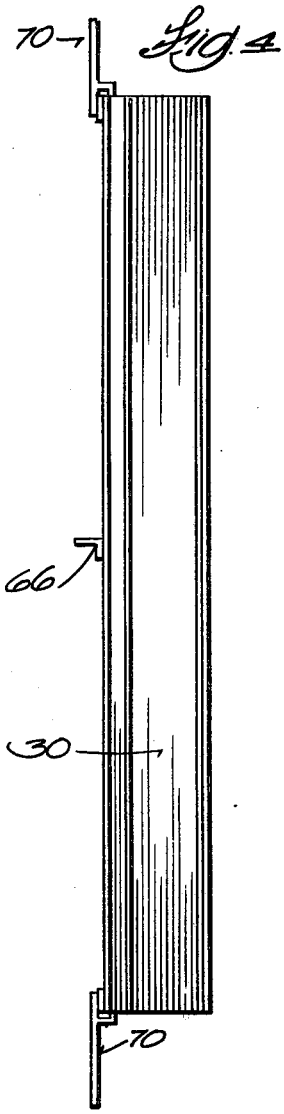
FIG. 4 is a side view of the mold assembly shown in FIG. 3.

Referring to FIG. 1, the form assembly includes a side rail 12 which has an out-turned upper clamping flange 14 and an out-turned or laterally projecting lower flange 16. The ledge 18 is adapted to mold the projecting flange 20 (FIG. 2) of the panel, and the V-shaped portion 22 provides the groove 24 of the panel. The other side rail 30 is identical with side rail 12 and has a laterally projecting upper clamping flange 32 and a laterally projecting lower clamping flange 34. Web portion 36 is spaced above the flange 34 so that when the rail 30 is assembled there is clearance beneath the web 36 and base plate 40 to mold the flange 42 (FIG. 2). The end rails or headers 50 are provided with projecting end portions 52 and projecting end portion 54 to provide clamping surfaces to secure the end rails to the side rails as hereinafter described.

The mold assembly also includes a central base plate 40 and two smaller base plates 60 and 62. The tie member 66 in the form of an angle iron can also be employed to fasten the tops of the side rails 12 and 30 together with clamps. The plate 40 has a sufficient width so that it can be manipulated with the fork 61 (FIG. 1) of a fork lift truck. After the concrete has set, the side rails and headers can be removed and the plate 40 and the concrete panel moved to a curing site.

Figure 5:
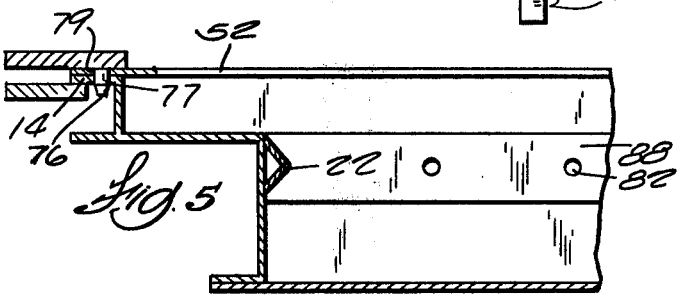
FIG. 5 is an enlarged fragmentary sectional end view.
Figure 7:
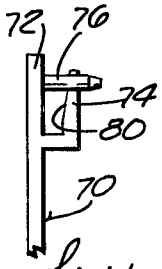
FIG. 7 is a side view of the clamp.

Clamping means 69 (FIGS. 7, 12) are provided to clamp the various components of the mold assembly together and include an arm 70 with opposed jaws 72 and 74 and a pin 76 which extends from jaw 72 and projects beyond the lower jaw 74. The lower jaw 74 has a ramp or cam surface 80 for wedging the jaws tight against the form parts to clamp the form parts together. As illustrated in FIG. 5, the pin 76 is extended through registrable apertures 77, 79 in the projecting portion 52 and flange 14. It is then swung to engage the ramp surface 80 of the lower jaw with the mold parts, thus pressing the flange 14 against the projecting portion 52. The clamps 70 are employed to clamp flange 32 to projecting portion 54 and employed to clamp the flange 16 to the base plates 40 and 62.

Figure 6:
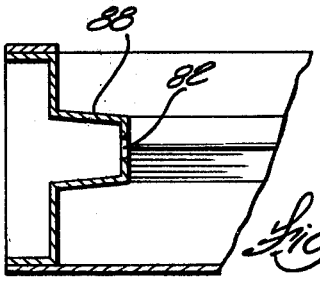
FIG. 6 is a view along line 6—6 of FIG. 3.

The end rails or headers 50 can be provided with an inturned portion 88 (FIG. 6) with apertures 82 so that wires can be extended through the length of the form to support paperboard tubes 90 which are employed to provide insulation and lower the weight of the panels.

Figure 8:
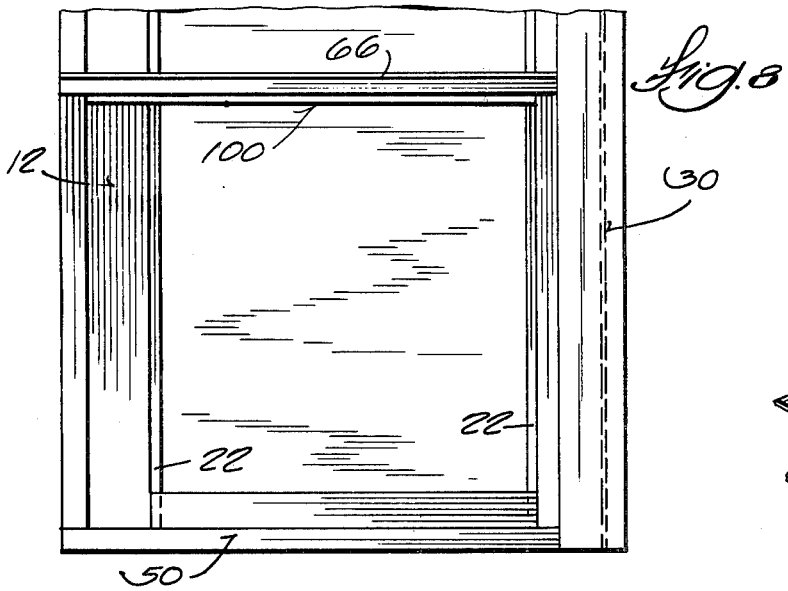
FIG. 8 is a top view of the mold assembly showing the divider for making short panels.
Figure 9:
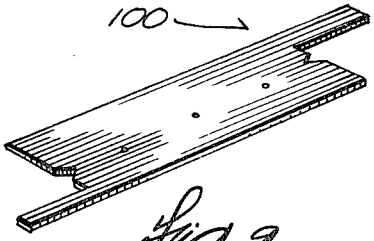
FIG. 9 is a perspective view of the divider shown in FIG. 8.

To form concrete panels of different length, a divider 100 can be employed (FIG. 8). The divider 100 is shaped (FIG. 9) to interfit between the side rails and is clamped to the tie 66.

Figure 10:
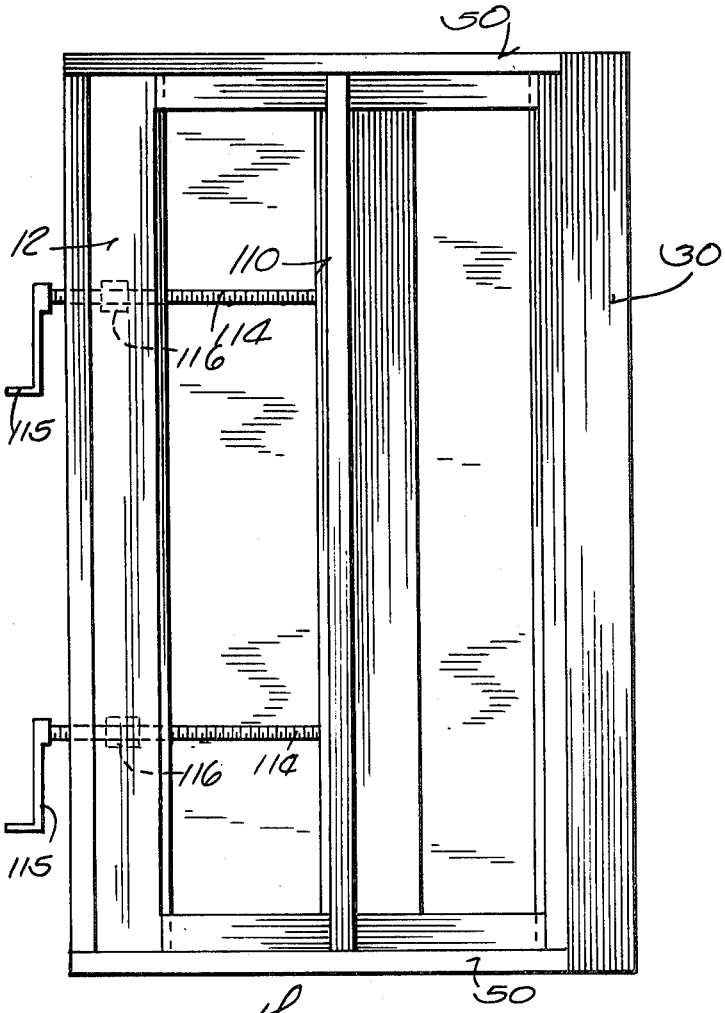
FIG. 10 is a top view of the mold assembly showing the adjustable side rail for molding panels of special widths.
Figure 11:
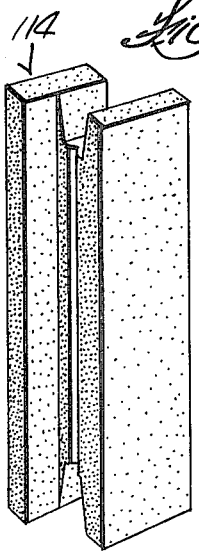
FIG. 11 is a perspective view of a panel made with the mold assembly shown in FIG. 10.

FIG. 10 shows an intermediate side rail 110 which is sized to interfit between the end rails 50 to adjust the width of the cast panels. Screws 114 provided with crank handles 115 and nuts 116 secured to the side rail 110 enable adjustment of the position of the rail 110. FIG. 11 illustrates a panel 114 of less width than the panel shown in FIG. 2 using the intermediate side rail 110.

What is claimed is:

1. A concrete form assembly for precasting concrete wall panels comprising a base plate, first and second side rails, first and second headers, said side rails being generally L-shaped in configuration with first and second legs, said side rails having the same cross-section and having first and second out-turned clamping flanges, with said first flanges being generally L-shaped in configuration and said first flanges being secured to said second legs of said side rails in stepped relation thereto and said second flanges being connected to the ends of said first legs at right angles therewith and extending from said first legs in the same direction as said second legs and parallel to the second legs, said headers having body portions and projecting portions which in assembly overlap said out-turned flanges of said side rails and clamping means to clamp said first and second flanges of said side rails to said projecting portions on said headers and to clamp said base plate to said side rails, with said first flange of one of said side rails abutting said base plate and the second flange of the other side rail abutting said base plate so that a projecting tongue portion can be formed on one edge of a wall panel adjacent said base plate and a projecting tongue portion can be formed on the other edge of the panel at a point spaced above said base plate.

2. A form assembly in accordance with claim 1 wherein said base plate comprises three portions with a central portion and two end portions, and said central portion is a sufficient width so that the molded concrete can be supported by the base plate central portion and moved from the pouring site to a curing site by lifting said central portion of said base plate.

3. A concrete form assembly in accordance with claim 1 in which the headers interfit within said side rails and are adjustable longitudinally of the side rails.

* * * * *